United States Patent [19]

Leolli

[11] Patent Number: 4,690,289

[45] Date of Patent: Sep. 1, 1987

[54] SECTIONAL MODULAR ELEMENT DISPLAY UNIT

[75] Inventor: Franco Leolli, Magliaso Ticino, Switzerland

[73] Assignee: Modecor Italiana S.p.A., Varese, Italy

[21] Appl. No.: 844,130

[22] Filed: Mar. 26, 1986

[30] Foreign Application Priority Data

Apr. 12, 1985 [IT] Italy ..... 21429/85[U]

[51] Int. Cl.[4] ..... A47F 5/00

[52] U.S. Cl. ..... 211/186; 108/111; 211/175; 211/189

[58] Field of Search ..... 211/189, 194, 175, 186; 108/111, 150

[56] References Cited

U.S. PATENT DOCUMENTS

| | | | |
|---|---|---|---|
| 3,170,418 | 2/1965 | Gruenstein | 211/186 X |
| 3,664,275 | 5/1972 | Kleinert | 108/150 |
| 4,428,305 | 1/1984 | Creske | 108/150 |

*Primary Examiner*—Robert W. Gibson, Jr.

*Attorney, Agent, or Firm*—Stevens, Davis, Miller & Mosher

[57] ABSTRACT

A display unit with variously combinable modular elements, comprises in combination: a plurality of plastic sections of different lengths which can be removably interlinked along their longitudinal edges by jointing means, so as to form a self-supporting structure, there being removably mountable respective support surfaces at the top of each of said sections, by means of intermediate connection means.

3 Claims, 4 Drawing Figures

SECTIONAL MODULAR ELEMENT DISPLAY UNIT

The present invention relates to a display unit, particularly but not exclusively for displaying confectionery and food product in general, typically formed of a plurality of modular elements capable of being variously combined so as to obtain different structures.

This display unit according to the invention comprises, in combination: a plurality of sections of different lengths constructed from plastics material which can be removably interlinked along their longitudinal edges by jointing means, so as to form a self-bearing structure, there being removably mountable respective support surfaces at the top of each of said sections, by means of intermediate connection means.

Preferably the said sections consist of slightly curved cross section laths interlinked through the intermediary of the said jointing means, which are composed of an H-shaped portion and a slit hollow portion, provided respectively on the opposed longitudinal edges of each lath, and cooperating.

The said support surfaces are for preference circular and are mounted at the top of the sections through the instrumentality of the said intermediate connection means which consist of a tongue fixed to the top of the upright, which tongue can be removably inserted within a complementary seating provided below the support surface.

For preference, a plurality of the said interlinked sections provided with relative top support surfaces is mountable mortise wise on a base.

The structural and functional characteristics of the invention, and its advantages, will become more apparent from an examination of the following exemplifying and not limiting description of one form of embodiment thereof, with reference to the appended drawings in which:

BRIEF DESCRIPTON OF THE DRAWINGS

Figure 1:
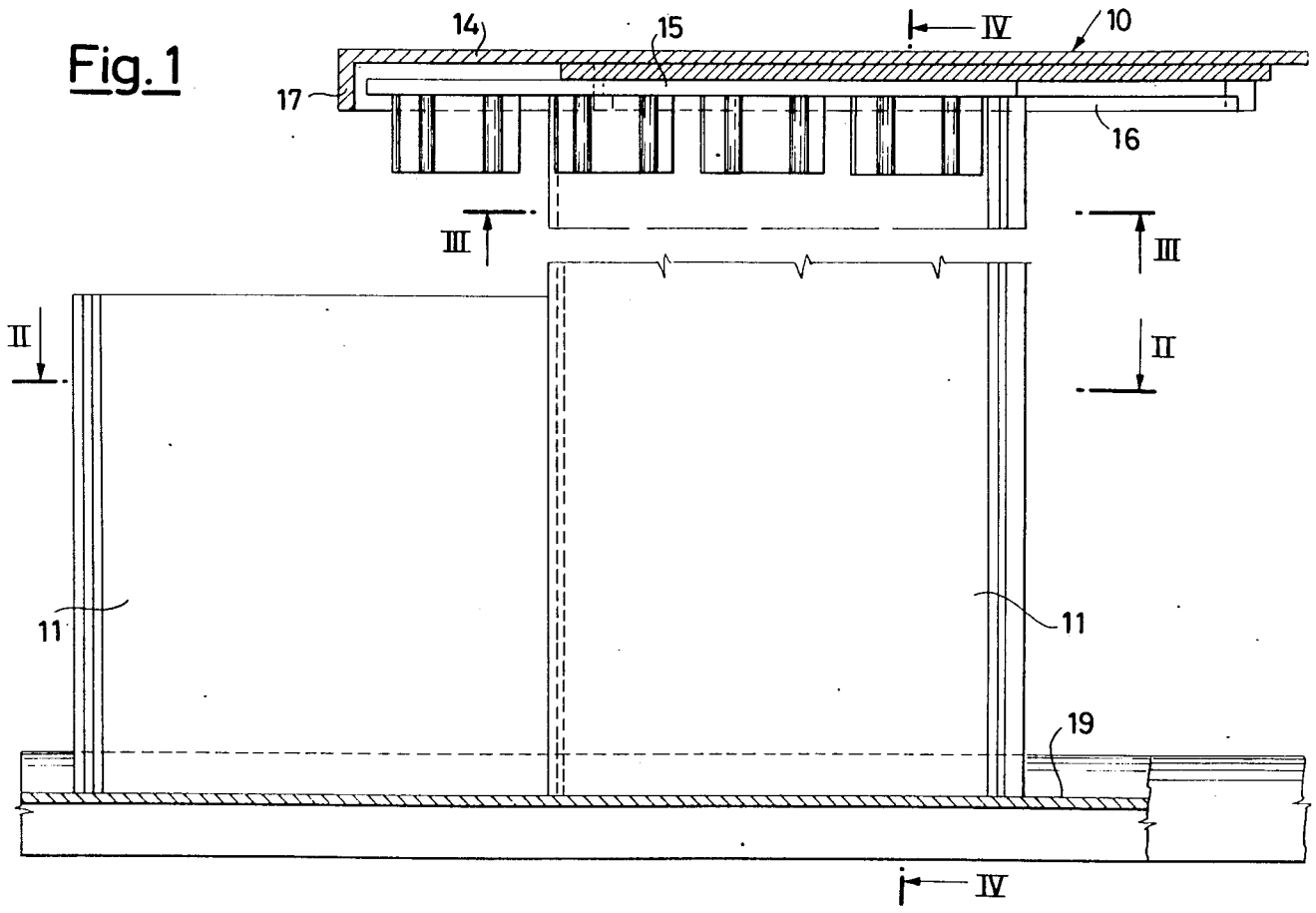
FIG. 1 is a partially sectioned elevational view of a display unit incorporating the innovative principles of the invention.
Figure 4:
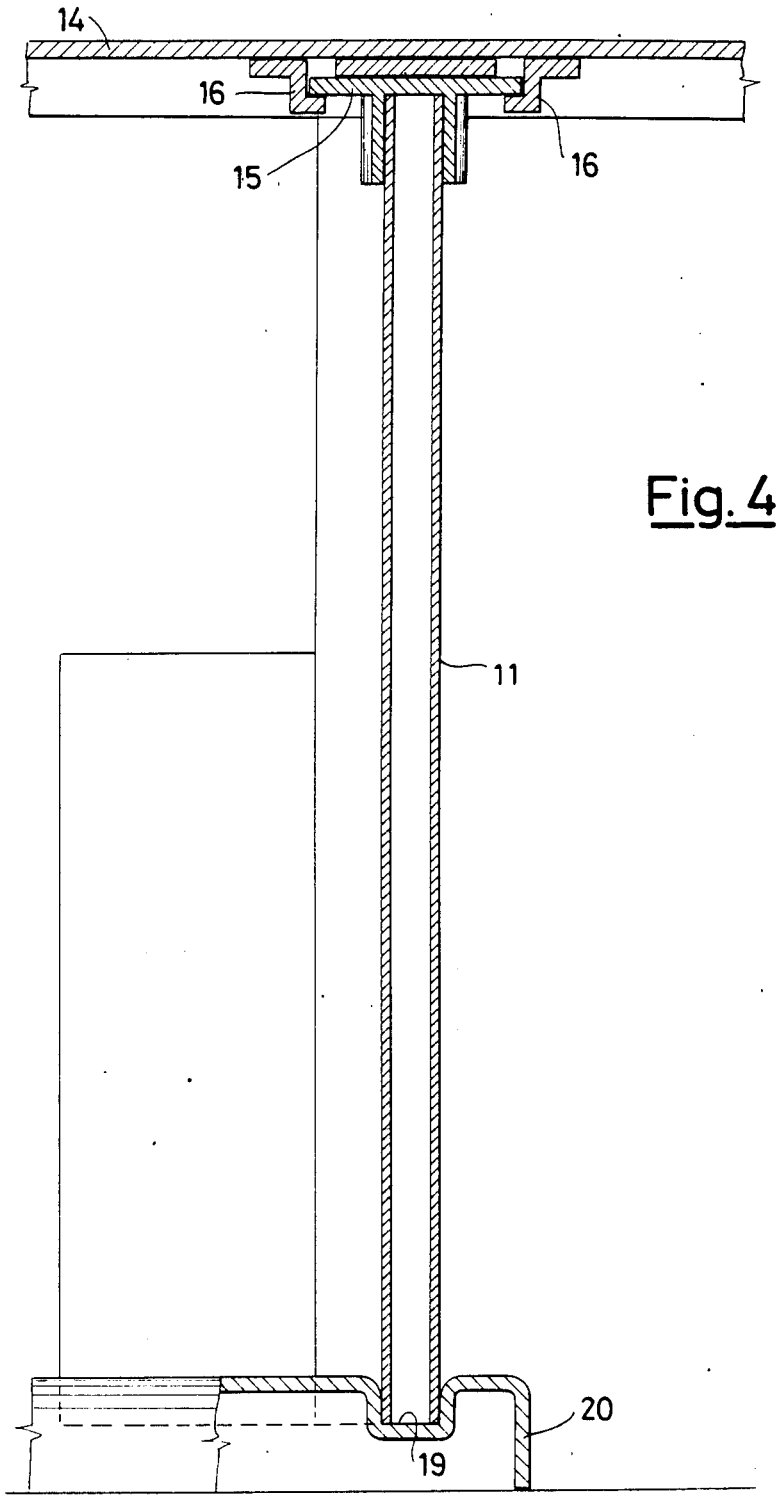

and FIG. 4 is a section taken on the line IV—IV in FIG. 1.

In the drawings a display unit embodied according to the invention is indicated overall by 10, and is structurally composed of a plurality of plastic sections 11 interlinked along their edges.

For the sake of simplicity the drawings show only two sections, but as will be clear they can be more numerous, and can also be disposed sinusoidally.

As the drawings clearly show, the sections 11 are preferably arcuate and have a double-wall structure with longitudinal stiffening ribs.

Figure 2:
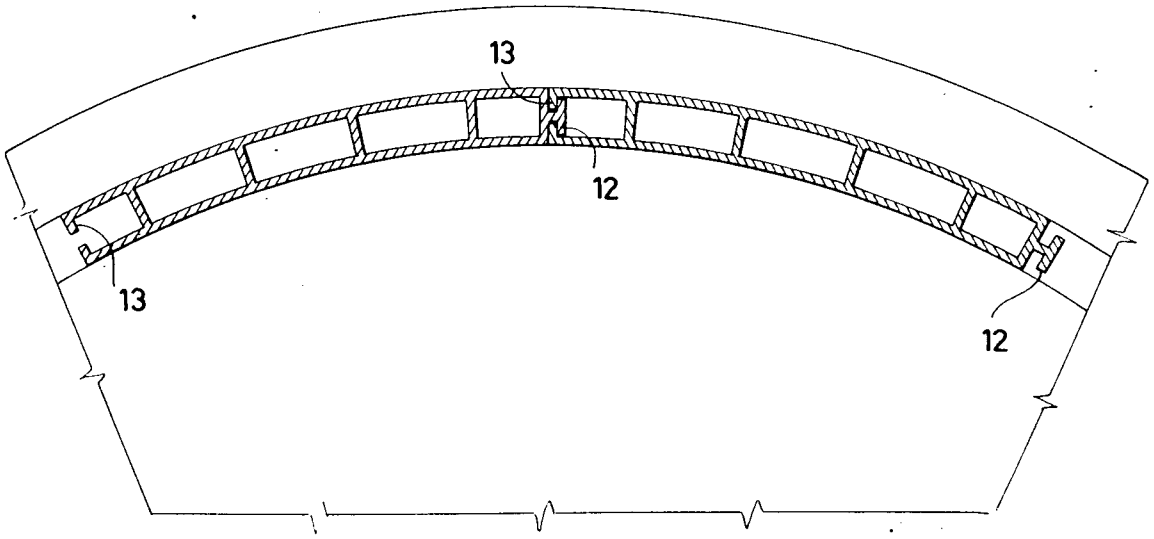
FIG. 2 is a section taken on the line II—II in FIG. 1.

The reciprocal linking of the sections 11 is effected by means of an H-shaped portion 12 and a slit hollow portion 13 provided respectively on the opposed longitudinal edges of the sections 11 (FIG. 2), and cooperating.

Figure 3:
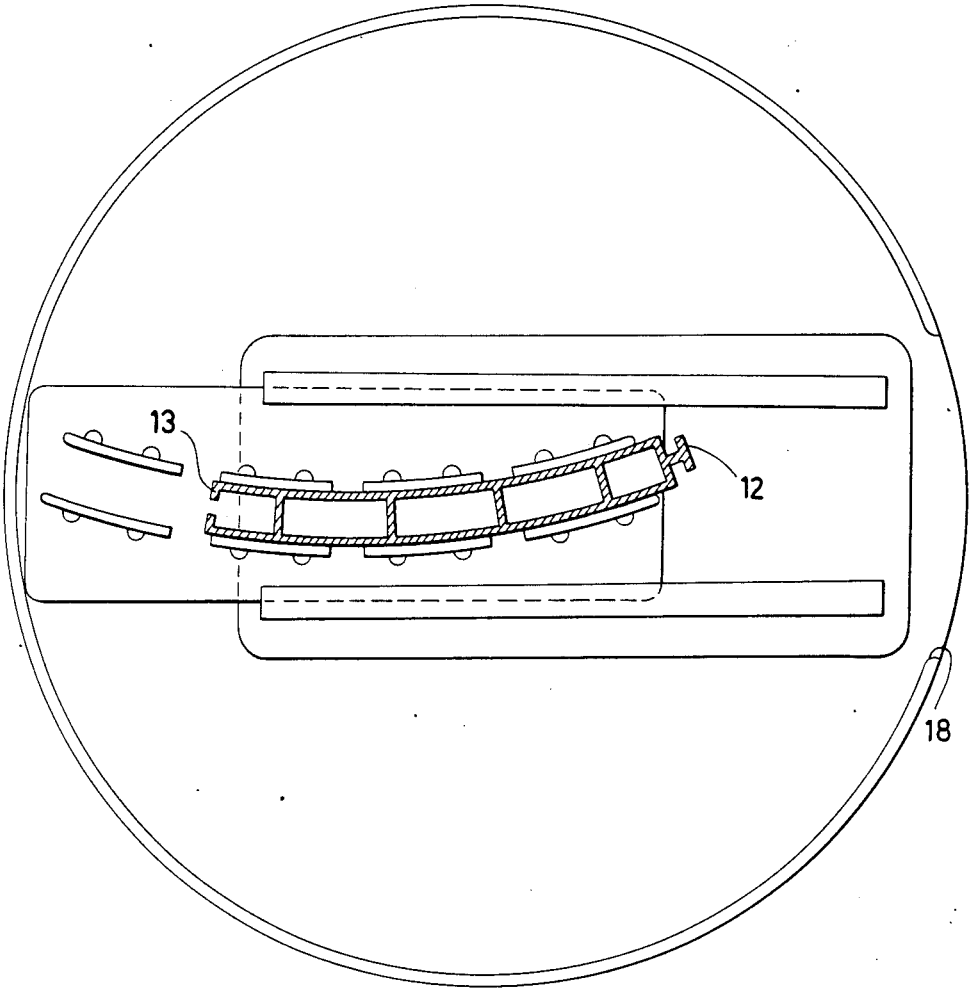
FIG. 3 is a section taken on the line III—III in FIG. 1.

In addition, a circular support surface 14 is removably mounted at the top of the sections 11 by means of a tongue 15 fixed astride each section 11 and inserted within a complementary seating consisting of a pair of opposed guides 16 below said surface 14 (FIGS. 3 and 4).

In order to permit the tongue 15 to be inserted into the guides 16, the edge 17 of the surface 14 is lacking in the zone 18.

Although per se self-supporting, a plurality of sections 11 of different heights interlinked in the manner described above and with surfaces 14 is preferably mounted in mortise fashion within a hollow 19 of a support base 20 (FIG. 4).

There is in this way obtained a display unit having sectional modular elements, which display unit can be given a wide variety of shapes and sizes at will over time, is relatively straightforward and economical to construct and is readily mountable and demountable even by non-skilled persons. Moreover, its detached parts can be packaged within a small space and this permits a great saving in despatch costs.

What is claimed is:

1. A display unit with variously combinable modular elements, comprising in combination: a plurality of vertically positioned plastic elongated sections of different lengths removably interlinked along their longitudinal edges by complementary jointing means to form a self-supporting structure, intermediate connection means removably mounted on upper ends of said sections and support surfaces removably mounted on said intermediate connection means, said elongated sections consisting of slightly curved section laths having complementary jointing means on either longitudinal edge, said jointing means being composed of an H-shaped portion and a slit hollow portion.

2. A display unit with variously combinable modular elements, comprising in combination: a plurality of vertically positioned plastic elongated sections of different lengths removably interlinked along their longitudinal edges by complementary jointing means to form a self-supporting structure, intermediate connection means removably mounted on upper ends of said sections and support surfaces removably mounted on said intermediate connection means, said support surfaces being circular and having guides on the bottom thereof and said intermediate connection means comprising a tongue slidable within said guides and from which append legs mountable on either side of said sections.

3. A display unit with variously combinable modular elements, comprising in combination: a plurality of vertically positioned plastic elongated sections of different lengths removably interlinked along their longitudinal edges by complementary jointing means to form a self-supporting structure, intermediate connection means removably mounted on upper ends of said sections, support surfaces removably mounted on said intermediate connection means and a base having a groove therein, a plurality of said interlinked sections being mounted in mortis fashion on said base.

* * * * *